US006091244A

United States Patent [19]

Rottler

[11] Patent Number: 6,091,244

[45] Date of Patent: Jul. 18, 2000

[54] METHOD AND ARRANGEMENT FOR DETECTING COMBUSTION MISFIRES OF A INTERNAL COMBUSTION ENGINE

[75] Inventor: Juergen Rottler, Karlsruhs, Germany

[73] Assignee: Robert Bosch GmbH, Stuttgart, Germany

[21] Appl. No.: 09/102,779

[22] Filed: Jun. 23, 1998

[30] Foreign Application Priority Data

Jun. 25, 1997 [DE] Germany ..... 197 27 004

[51] Int. Cl.[7] ..... F02P 17/00

[52] U.S. Cl. ..... 324/378; 324/380; 324/391; 324/393; 324/399; 324/459; 73/35.04; 73/35.06; 73/35.08; 73/117.2; 73/117.3; 123/406.27; 123/406.35; 123/436

[58] Field of Search ..... 324/378, 399, 324/402, 379, 380, 408, 407, 409; 73/116, 117.3, 35.08, 35.06; 123/436, 406.27, 406.35

[56] References Cited

U.S. PATENT DOCUMENTS 5,180,984 1/1993 Murata et al. ..... 324/399
5,343,844 9/1994 Fukui et al. ..... 123/481
5,561,239 10/1996 Yasuda ..... 73/35.08
5,563,332 10/1996 Yasuda ..... 73/35.08
5,675,072 10/1997 Yasuda et al. ..... 73/35.08

*Primary Examiner*—Josie Ballato
*Assistant Examiner*—Anjan K Deb
*Attorney, Agent, or Firm*—Walter Ottesen

[57] ABSTRACT

The invention is directed to a method of detecting combustion misfires of an internal combustion engine wherein an ion current is generated during the operation of the engine. The ion current signal is detected over a pregiven time interval starting with the discharge of a spark plug. The ion current signal is integrated over time with a weighting function to obtain a weighted integrated signal and the weighting function is adapted to previously detected ion current signals. The maximum of the weighted integrated signal is compared to a threshold value (s_io) dependent upon engine rpm (nmot) and load (rl). A fault signal is outputted when the threshold value (s_io) is not exceeded. The invention is also directed to an arrangement for detecting the combustion misfires.

7 Claims, 1 Drawing Sheet

METHOD AND ARRANGEMENT FOR DETECTING COMBUSTION MISFIRES OF A INTERNAL COMBUSTION ENGINE

FIELD OF THE INVENTION

The invention relates to a method for detecting ignition misfires of an internal combustion engine by detecting the ion current signal. The ion current signal is detected over a pregiven time interval starting with the discharge of the spark plug, is integrated over time and the maximum of the integrated signal is compared to a threshold value which is dependent upon rpm and load. A fault signal is outputted when the threshold value is not exceeded.

BACKGROUND OF THE INVENTION

The detection of exhaust-gas relevant quantities of an internal combustion engine utilizing on board diagnostic equipment (OBD) is a stringent requirement of United States Federal Regulations. Combustion misfires, inter alia, must be detected utilizing on board means. Various methods exist for this purpose.

It is, for example, known to evaluate combustion misfires by evaluating the rough running of the crankshaft. For this purpose, the fluctuations of the crankshaft angular velocity are used during one or more camshaft rotations. Because of combustion misfires in one or several cylinders, the driving torque is not present and the angular velocity thereby becomes less because of the unchanged applied drive torque. Subsequent regular combustions accelerate the crankshaft again. The fluctuations of the angular velocity are that much more pronounced the lower the engine rpm and the higher the engine load. What is problematic about this method is that, for example, the misfiring of all cylinders at the same time is poorly detectable because this fault has the effect of an intended transition into the overrun mode of operation. In this case, the crankshaft angular velocity decreases uniformly. The method of detecting combustion misfires from fluctuations of the rpm is furthermore unsuitable at high rpms of the engine when these high rpms are associated with a low engine load.

Furthermore, methods are known to detect combustion misfires by evaluating the combustion chamber pressure. A pressure increase develops in the cylinders of the engine because of the combustion. This pressure can be detected by a sensor and be applied as a measure for the proper combustion.

What is problematic in this method is that an additional sensor is required for each cylinder. This sensor not only requires early consideration in the construction of the engine but especially causes additional costs.

Furthermore, the above-mentioned methods for detecting combustion misfires of an internal combustion engine via detecting the ion current signal are known. For example, a method of this kind is disclosed in U.S. Pat. No. 5,343,844 incorporated herein by reference. This patent also provides background information as to the ion current referred to above and hereinafter. It is advantageous in these methods that they require no additional sensor means and that the feature, which detects the combustion misfire, can be derived directly from the combustion operation. In this method, the ion current signal is either compared directly or after a time integration to a pregiven threshold value and, only when the threshold value is not exceeded, a fault signal is outputted. In these methods, it is problematic that smaller changes of the ion current signal can only be poorly detected and, for this reason, a fault can be signalled in extreme cases even though no combustion misfire is present.

The above is then especially the case when a relatively large offset signal is superposed upon an ion current signal caused by a combustion operation so that the actual ion current signal, which is caused by the combustion, can only be separated from the offset signal with great difficulty. Problems result here also with "flat" signal traces, that is, signal traces which are not adequately pronounced. In the integration of signals, which have a high offset, and because of the integration of the offset signal together with the actual signal to be detected, combustion misfires cannot be precisely detected under some circumstances. This is so because the integral of a very large offset signal can be greater than the pregiven threshold value and, for this reason, a proper combustion can be incorrectly assumed.

Because of the very large scattering of the ion current signal, it is not practical to subtract a certain offset quantity ab initio from the actual measuring signal.

Methods of this kind for detecting combustion misfires by detecting the ion current signal therefore impose high requirements on the evaluation of the signal. This is especially so because the ion current signals are very small compared to, for example, the ignition current and disturbances can also occur.

SUMMARY OF THE INVENTION

It is an object of the invention to provide a method for detecting combustion misfires of internal combustion engine of the kind described above which is improved so that a precise detection of the combustion misfires is possible even for small ion current signals burdened with a flat trace and with a relatively large fluctuating offset.

The method of the invention is for detecting combustion misfires of an internal combustion engine wherein an ion current signal is generated during the operation of the engine. The engine has a spark plug and the method includes the steps of: detecting the ion current signal over a pregiven time interval starting with the discharge of the spark plug; integrating the ion current signal over time with a weighting function to obtain a weighted integrated signal and the weighting function being adapted to previously detected ion current signals; comparing the maximum of the weighted integrated signal to a threshold value (s_io) dependent upon engine rpm (nmot) and load (rl); and, outputting a fault signal when the threshold value (s_io) is not exceeded.

Physically based and partially engine independent characteristics of the ion current signal are considered by the weighting function in an especially advantageous manner for increasing the measuring accuracy.

It is advantageously provided that the offset of the ion current signal is detected and is eliminated from the weighted integrated signal.

The most different embodiments are conceivable with respect to the determination of the threshold value.

In an advantageous embodiment, the threshold value is determined continuously in dependence upon the rpm and the load signal of the engine.

In another advantageous embodiment, the threshold value is stored in a characteristic field having the independent parameters of rpm and the load signal of the engine.

It is also the object of the invention to provide an arrangement for detecting combustion misfires of an internal combustion engine wherein a reliable detection of combustion misfires is made possible even for small and poorly pronounced ion current signals.

The arrangement of the invention is for detecting combustion misfires of an internal combustion engine wherein an ion current is generated during operation of the engine. The arrangement includes: a device for detecting the ion current; an ion current processing apparatus for processing the ion current to form a processed ion current; a threshold value forming unit for forming a threshold value (s_io) from engine rpm (nmot) and engine load (rl); a comparator for making a comparison of the processed ion current to the threshold value (s_io); a control unit for permitting the comparison only in a pregiven window of time; and, the ion current processing apparatus including a matched filter adapted to the physical caused characteristics and/or circuit caused characteristics of the ion current signal; an offset filter connected in parallel with the matched filter for eliminating the offset of the ion current; and, a maximum value former connected downstream of the matched filter and the offset filter.

The most different embodiments are conceivable with respect to the configuration of the matched filter. An advantageous and especially simple embodiment provides that the matched filter is a bandpass filter having adjustable parameters. This embodiment can be configured as an integrated circuit.

BRIEF DESCRIPTION OF THE DRAWINGS

The invention will now be described with reference to the single figure of the drawing (FIG. 1) which shows an arrangement according to the invention for detecting ignition misfires of an internal combustion engine.

DESCRIPTION OF THE PREFERRED EMBODIMENTS OF THE INVENTION

Figure 1:
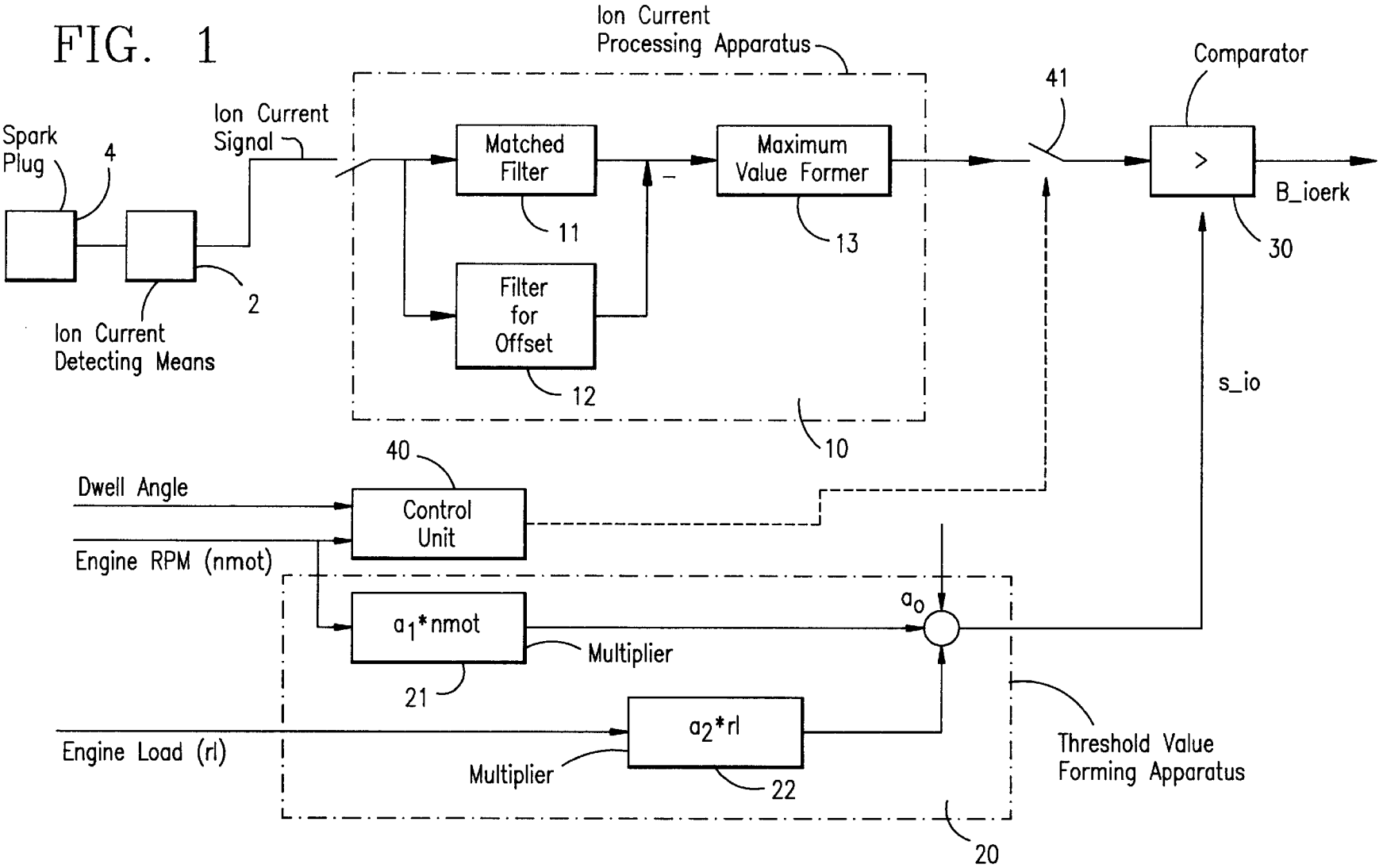

An embodiment of an arrangement for detecting ignition misfires of an internal combustion engine (not shown) is shown in FIG. 1. The arrangement includes a device 2 known per se for detecting the ion current which outputs an ion current signal. The ion current signal is detected by device 2 over a pregiven time interval starting with the discharge of a spark plug 4. An ion current processing apparatus 10 is connected downstream of this ion current detecting device.

The arrangement further includes an apparatus 20 for forming a threshold value s_io from the rpm nmot and the load signal rl of the engine. The apparatus for forming the threshold value s_io forms a threshold value s_io from the rpm nmot, the load signal rl and other constants a0, a1, a2 in a manner known per se. This threshold value s_io is supplied to a comparator 30 as is the ion current signal leaving the ion current processing apparatus 10. The comparator 30 compares the processed ion current signal to the threshold value s_io. A fault signal B_ioerk is outputted when the threshold value s_io is not exceeded.

Furthermore, a control unit 40 is provided which makes a comparison possible only in a pregiven time window, namely, in a pregiven time interval starting with the discharge of the spark plug. A dwell angle signal as well as the rpm nmot of the engine are supplied to the control unit 40. From this, the control unit 40 determines the start and end of this time window in a manner known per se.

In lieu of the apparatus for forming a threshold value s_io from the rpm nmot and the load signal rl of the engine, in another embodiment (not shown), a characteristic field can be used having the rpm nmot and the load signal rl as independent variables and having, as a dependent variable, the threshold value s_io.

The ion current processing apparatus 10 includes a matched filter 11 which is adapted to the physically based characteristics of the ion current signal and the apparatus for detecting the ion current. A filter 12 is connected in parallel to this matched filter 11 and eliminates the offset of the ion current signal, for example, by subtraction as shown or even by multiple differentiation and integration or in some other suitable manner. A maximum value former 13 is connected downstream of the matched filter 11 and the filter 12. This maximum value former 13 determines the maximum value of the ion current signal processed with the aid of the matched filter 11 and the filter 12.

As indicated by switch 41, the signal leaving the ion current processing unit 10 is always then compared to the threshold value s_io in the comparator 30 when the peripheral conditions, which are detected by the control unit 40, are satisfied. As mentioned above, these peripheral conditions are satisfied within a pregiven time window, which is detected by the control unit 40, and encompasses a pregiven time interval starting from the discharge of the spark plug.

The matched filter 11 can, for example, be a bandpass filter having adjustable parameters.

The method for detecting combustion misfires of an internal combustion engine by detecting the ion current signal is best described with respect to the arrangement shown in FIG. 1. The ion current signal is outputted by the unit for detecting the ion current and is supplied to the ion current processing apparatus 10. In apparatus 10, a time integration of the ion current signal with a weighting function is carried out in a matched filter 11. The weighting function is adapted to previously detected ion current signals. The weighted time integration can, for example, be a suitable convolution of the ion current signal with a convolution function adapted to previously detected ion current signals. Simultaneously herewith, an offset of the ion current signal (if present) is eliminated by the filter 12 and, thereafter, the maximum of the ion current signal so processed is formed in a maximum value former 13 and is stored.

At the same time, the threshold value s_io is determined from the rpm nmot and the load signal rl in the apparatus 20 for forming the threshold value. The rpm nmot is multiplied by a constant a1 in a multiplier 21 and the load signal rl is multiplied by a constant a2 in a multiplier 22. The multiplied quantities are then processed with a further constant a0 to the threshold value s_io. The ion current signal is processed by the ion current signal processing apparatus 10 and this ion current signal as well as the threshold value s_io are supplied to a comparator 30.

However, a comparison only takes place when a switch 41 is closed by the control unit 40 to which the dwell angle setting and the rpm nmot of the engine are supplied. The switch 41 is closed in a pregiven time interval starting from the discharge of the spark plug, that is, the comparison only takes place in a pregiven time window wherein the ignition current or other disturbing influences are not superposed on the ion current signal.

With the method and arrangement described herein, it is possible to reliably detect combustion misfires with the aid of the ion current effect in all operating points of the engine.

It is especially advantageous that the entire arrangement can be integrated in a cost-effective manner into engine controls or can be realized as a cost-effective ancillary component. The entire arrangement and especially the matched filter 11 and the filter for the offset 12 can be configured as one or more integrated circuits.

It is understood that the foregoing description is that of the preferred embodiments of the invention and that various changes and modifications may be made thereto without departing from the spirit and scope of the invention as defined in the appended claims.

What is claimed is:

1. A method of detecting combustion misfires of an internal combustion engine wherein an ion current signal is generated during the operation of the engine, the engine having a spark plug and the method comprising the steps of:

detecting said ion current signal over a pregiven time interval starting with the discharge of said spark plug;

integrating said ion current signal over time with a weighting function to obtain a weighted integrated signal and said weighting function being adapted to previously detected ion current signals;

comparing the maximum of said weighted integrated signal to a threshold value (s_io) dependent upon engine rpm (nmot) and load (rl); and, outputting a fault signal when said threshold value (s_io) is not exceeded.

2. The method of claim 1, comprising the further steps of:

detecting an offset of said ion current signal; and, eliminating said offset from the weighted integrated signal.

3. The method of claim 1, comprising the further step of continuously determining said threshold value (s_io) in dependence upon said engine rpm (nmot) and said load (rl).

4. The method of claim 1, comprising the further step of storing said threshold value (s_io) in a characteristic field having said engine rpm (nmot) and said load (rl) as independent parameters.

5. An arrangement for detecting ignition misfires of an internal combustion engine wherein an ion current is generated during operation of the engine, the arrangement comprising:

a device for detecting said ion current;

an ion current processing apparatus for processing said ion current to form a processed ion current;

a threshold value forming unit for forming a threshold value (s_io) from engine rpm (nmot) and engine load (rl);

a comparator for making a comparison of said processed ion current to said threshold value (s_io);

a control unit for permitting said comparison only in a pregiven window of time; and, said ion current processing apparatus including a matched filter adapted to the physical caused characteristics and/or circuit caused characteristics of said ion current signal; an offset filter connected in parallel with said matched filter for eliminating the offset of said ion current; and, a maximum value former connected downstream of said matched filter and said offset filter.

6. The arrangement of claim 5, said matched filter being a bandpass filter having adjustable parameters.

7. The arrangement of claim 6, wherein the arrangement is part of an integrated circuit.

* * * * *